US006373175B1

(12) United States Patent
Cade et al.

(10) Patent No.: US 6,373,175 B1
(45) Date of Patent: Apr. 16, 2002

(54) ELECTRONIC SWITCHING DEVICES

(75) Inventors: Neil Alexander Cade, Rickmansworth; David Francis Howell, Maidenhead, both of (GB)

(73) Assignee: GEC-Marconi Limited (GB)

( * ) Notice: Subject to any disclaimer, the term of this patent is extended or adjusted under 35 U.S.C. 154(b) by 0 days.

(21) Appl. No.: 07/731,409

(22) Filed: Jul. 10, 1991

(30) Foreign Application Priority Data

Jul. 13, 1990 (GB) ..... 9015392

(51) Int. Cl.[7] ..... H01J 1/16; H01J 29/46
(52) U.S. Cl. ..... 313/336; 313/306; 315/14
(58) Field of Search ..... 313/495, 336, 313/497, 306; 315/14, 111.81; 445/24, 52; 327/365

(56) References Cited

U.S. PATENT DOCUMENTS 4,163,949 A * 8/1979 Shelton ..... 328/254
4,745,325 A * 5/1988 True ..... 313/296
5,070,282 A * 12/1991 Epsztein ..... 313/336

FOREIGN PATENT DOCUMENTS

| | | | |
|---|---|---|---|
| GB | 1498232 | * | 1/1978 |
| GB | 1555800 | * | 11/1979 |
| GB | 2153104 | * | 8/1985 |
| WO | 8806345 | * | 8/1988 |

* cited by examiner

*Primary Examiner*—Gregory C. Issing
(74) *Attorney, Agent, or Firm*—Kirschstein, et al.

(57) ABSTRACT

A high-speed field emission vacuum switching device comprises a cathode tip formed on a substrate, an extraction grid close to the cathode tip, and a modulator grid spaced from the cathode tip by a dielectric layer. The grids have apertures aligned with the cathode tip. An anode is spaced from the modulator grid by a dielectric layer. By use of the modulator grid, a substantial improvement in high-frequency switching performance can be achieved. A collector grid may be provided between the extraction grid and the modulator grid, and a cut-off grid may be disposed between the modulator and collector grids.

5 Claims, 2 Drawing Sheets

ELECTRONIC SWITCHING DEVICES

BACKGROUND OF THE INVENTION

1. Field of the Invention

This invention relates to electronic switching devices, and particularly to vacuum devices in which electrons are emitted from a cathode by virtue of a field emission process.

2. Description of Related Art

Over the past thirty years, semiconductor device technology has replaced conventional vacuum device technology for all but the most specialised electronic applications. There are many reasons for the preference for semiconductor devices. For example, they are more reliable, they are considerably smaller and they are cheaper to produce than conventional vacuum devices. Furthermore, their power dissipation is much lower than that of thermionic vacuum devices, which require a considerable amount of cathode heating power.

However, in at least one respect vacuum devices are greatly superior to devices based on solid state materials. The vacuum devices are far less affected by exposure to extreme or hostile conditions, such as high and low temperatures. Because the band gaps of useful semiconductors are necessarily of the order of 1 ev and many other interband excitations are lower than this, the excitation of intrinsic carriers is significant and is strongly temperature-dependent at and above room temperature. This severely modifies the characteristics and the performance of semiconductor devices. In addition, the electron occupancy of the traps and other defect states which determine the properties of semiconductor structures is extremely temperature sensitive, particularly at low temperatures. The problems become increasingly acute with the trend towards smaller semiconductor devices and higher integration density.

Vacuum devices, on the other hand, suffer to a much smaller extent from such problems. The density of the conduction electrons which are responsible for thermionic and field emission processes is not dependent on temperature, and because the devices have barriers with large work functions, significant thermal activation requires a temperature of at least 1000° K.

However, solid state semiconductor devices can operate at high switching speeds, for example at a switching frequency of, say, 100 GHz. In view of the lower current densities which are achievable in vacuum electronic devices, it is generally accepted that vacuum devices must exhibit lower switching speeds.

SUMMARY OF THE INVENTION

It is an object of the present invention to provide a high-speed vacuum switching device.

According to the invention there is provided a vacuum switching device comprising a cathode; extraction electrode means adjacent the cathode for causing electron flow from the cathode; modulation grid means spaced from the cathode and the extraction electrode means for modulating the electron flow; and an anode structure spaced from the modulation grid means for receiving the modulated electron flow.

Further electrodes, such as a collector grid, may be located between the extraction electrode means and the anode structure.

BRIEF DESCRIPTION OF THE DRAWINGS

Embodiments of the invention will now be described, by way of example, with reference to the accompanying drawings, in which.

DETAILED DESCRIPTION OF THE PREFERRED EMBODIMENTS

Figure 1:
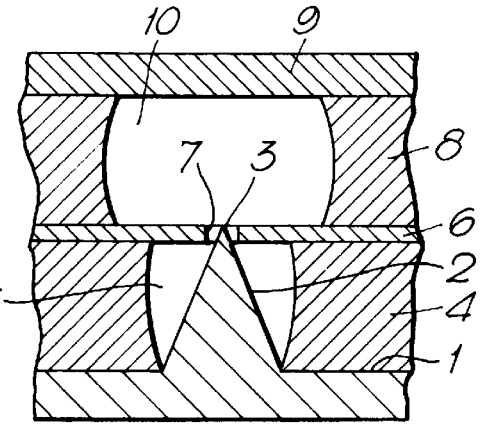
FIG. 1 is a schematic cross-section view of a known vacuum field emission triode according to the prior art.

Referring to FIG. 1 of the drawings, a known vacuum triode device comprises a silicon substrate 1 on which is formed, by etching the substrate, a tapered cathode body 2 having a tip 3. The cathode body may subsequently be coated with a thin electron transmissive layer to improve its electron emission properties. A layer 4 of insulating material is deposited over the substrate, with an aperture 5 therein around the cathode body 2. A control grid 6 is then formed in the same plane as the tip 3 and with an aperture 7 through which the tip is revealed. The control grid may comprise a doped polysilicon layer. A further dielectric layer 8 separates an anode layer 9 from the control grid 6, the layer 8 having an aperture 10 therein. The apertures 5, 7 and 10 are all coaxial with the cathode tip 3.

Such prior art device suffers from the disadvantage, noted above, of low switching speed. The reasons for the low speed are as follows.

The speed of any electronic device is limited by the transit time of the electrons and the time taken to charge the capacitance of the device. In the case of the transit time, this can be made as short as required by simply reducing the device dimensions, and is therefore generally not the important limiting factor. In the case of vacuum devices operating at a few hundred volts, the electron velocities are larger than in semiconductor devices, thereby allowing shorter transit times for rather larger dimensions than in semiconductor devices (typically ten times larger).

Although the transit time does impose an upper limit on the operating speed of the device, the time required to charge the parasitic capacitance of the device is usually a more severe limitation. In terms of the small signal representation of a generic three terminal device having the parameters:

| | |
|---|---|
| transconductance | $g_m$ |
| input voltage | $V_{in}$ |
| input current | $I_{in}$ |
| input capacitance | C |
| output current | $I_{out}$ |

The output current is related to the input voltage as follows:

$$I_{out}=g_m V_{in} \quad (1)$$

and $$V_{in} = \frac{1}{i\omega C} I_{in} \quad (2)$$

Therefore $$|I_{out}| = \frac{g_m}{\omega C} |I_{in}| \quad (3)$$

where the anode capacitance is neglected, as it can easily be made much smaller than the input capacitance C.

If an electronic device is to be able to be cascaded it must have a gain greater than unity. Hence, it is required that $|I_{out}| \geqq |I_{in}|$, so that $\omega \leqq g_m/C$. The cut-off frequency $f_c$ is therefore defined by $$f_c = \frac{g_m}{2\pi C} \quad (4)$$

It is clear that, for high speed operation, the transconductance must be maximised and the input capacitance minimised. In terms of the d.c. current-voltage characteristics of the device, $g_m$ is comparable with I/V and a large current is therefore required to flow in the device for as low a voltage as possible.

Operation at a higher frequency than $f_c$ might apparently be achieved by using distributed amplifier techniques to spread the gain over a number of separate devices or by restricting the bandwidth, for example by tuning out some of the input capacitance. However, in each of those cases the output signal is effectively "integrated up" over several periods of the input waveform. Consequently, no overall increase in device speed is achieved by adopting those techniques and, for switching devices, equation (4) above does, indeed, define the upper limit of switching speed.

A high-speed switch requires a high value of $g_m$ and a small value of C. In the known triode of FIG. 1, practical material properties should allow a current I of about 100 $\mu$A for an applied voltage V of about 100 volts, giving $g_m \sim I/V \sim 10^{-6}\Omega^{-1}$. However, in order to obtain such current levels at these low voltages, close grid-cathode spacing is required. A 2 $\mu$m gap is typically required, and this imposes a relatively large capacitance at the cathode tip of about $10^{-16}$ F, resulting in a value of $f_c \sim 10^9$ Hz. This is substantially lower than the speeds achieved with conventional semiconductor devices.

A considerable improvement in speed can, however, be achieved by a switching device in accordance with the present invention. A first embodiment of the invention will now be described with reference to FIG. 2 of the drawings. This device comprises a substrate 11 on which is formed a cathode body 12 having a tip 13, a grid 14 close to the tip 13 and an anode 15, generally similar to the device of FIG. 1. The substrate 11 may be formed of a semiconductor, for example silicon, a metal, a metal-coated semiconductor or a metal-coated insulator. The grid 14 may comprise a layer of a semiconductor, for example doped polysilicon, or a metallic layer.

In this device in accordance with the invention the grid 14 is not a modulator grid, but an electron extraction grid solely for causing emission from the cathode. The modulator grid 16 is located between the extraction grid 14 and the anode 15, and is spaced away from the cathode tip 13 by a dielectric layer 17. For ease of fabrication, the insulating layers should preferably be less than 2 $\mu$m thick, although larger spacings between the electrodes might be provided by using multilayer insulating structures or nonrefractory insulating materials. In order to obtain substantial electron emission at less than 200 volts the diameter of the aperture in the grid 14 around the tip 13 is preferably less than 1–2 $\mu$m. The tip 13 should preferably have a tip radius of about 10 nm.

By using a separate grid 16 to modulate the anode current, it is possible to obtain a large improvement in the high frequency performance compared to that of the simple field emission triode of FIG. 1. This is because:

(i) the input capacitance is greatly reduced because the gap between the anode and the modulator grid is no longer constrained by the tip height and the requirement for maximising the electric field at the tip; and (ii) the narrow energy spread of the field emitted electrons ($\Delta V < 1$ volt) can be utilised to increase $g_m$ by at least one order of magnitude (since $g_m$ is now approximately equal to $I/\Delta V$).

By introducing an additional electrode into the device it is possible effectively to separate the functions of electron emission and modulation. Hence, the physics of field emission no longer strongly limits the available options for controlling the current flowing in the device.

Figure 3:
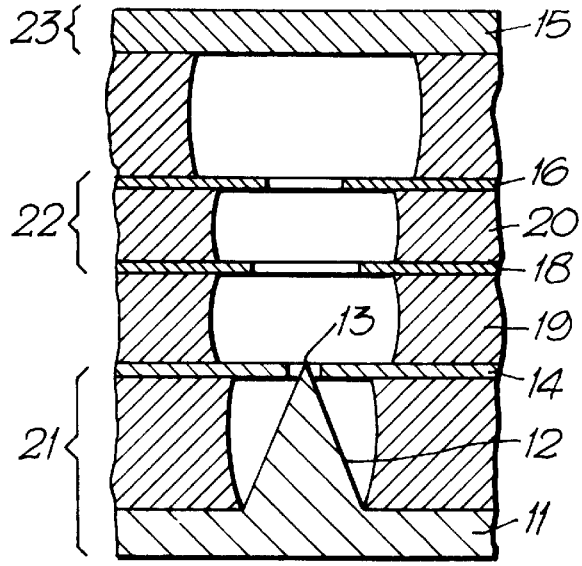
FIG. 3 is a schematic cross-sectional view of a second configuration of vacuum switching device in accordance with the invention.

In an alternative embodiment as shown in FIG. 3, an additional electrode, namely a collector grid 18, is disposed between the extraction grid 14 and the modulator grid 16. The collector grid is spaced from the extraction grid and the modulator grid by dielectric layers 19 and 20, respectively, which may have a thickness of, for example a few $\mu$m or less.

The collector grid 18 is biased to a potential appreciably lower than that of the extraction grid 14, but higher than that of the cathode. The anode may also be biased at a similar potential to the collector grid 18. When the input signal on the modulator grid is such that the anode current is switched off, the electrons are turned back by the modulator grid and are collected by the collector grid 18.

With the lower biasing of the collector grid 18, the energy dissipation is reduced in the switched-off state. The energy dissipation at the anode 15 is similarly reduced in the switched-on state by reducing the anode bias . There is, however, a slight increase in transit time because the electrons move more slowly in the region of the modulator grid when the biased collector grid is present.

Although only one cathode body is shown in each of the figures, and in principle that is all that is required, there may be many such bodies in a practicable device, where the additional tips in parallel may compensate for variations in tip performance. Given a current of 100 $\mu$A per tip, a transconductance $g_m$ of the order of $$g_m = \frac{I}{\Delta V} \sim \frac{10^{-5}}{10^{-1}}\Omega^{-1} = 10^{-4}\Omega^{-1}\text{per tip}$$

would be obtainable.

Even if the input capacitance is estimated at the rather high value of $10^{-16}$ F, the resulting cut-off frequency is of the order of 100 GHz. In principle, the input capacitance could be reduced by further increasing the gap between the modulator grid 16 and the electrode which is at AC ground potential (which might be either the cathode 11 (FIG. 2) or the collector grid 18 (FIG. 3)), in order to obtain some improvement in the switching speed up to a limit set by the electron transit time across the gap.

Figure 2:
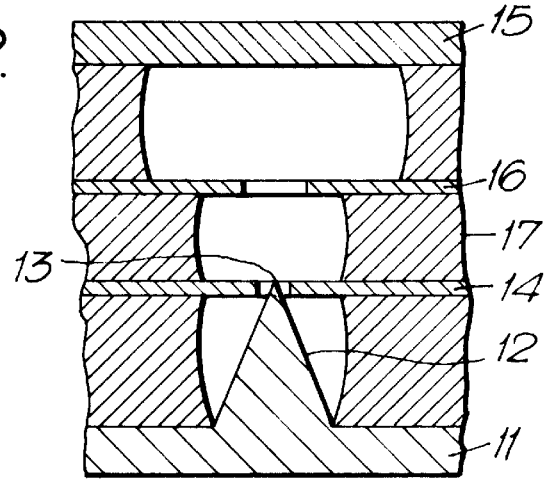
PRIOR ART Fig.2.
FIG. 2 is a schematic cross-sectional view of a first configuration of vacuum switching device in accordance with the invention.

The approximate electrode bias levels shown in FIGS. 2 and 3 are chosen so that the transit times do not constitute the speed limiting factor and such that the collection electrodes (e.g. the anode 15 and the collector grid 18 of FIG. 3) do collect substantially all of the electrons emitted from the cathode 11. The value of 30 volts on the ultimate collection electrodes is suggested to minimise loss of secondary electrons, but the most appropriate value will depend upon the particular electrode material. Although the modulator grid 16 and the cathode 11 of FIG. 3 are shown at zero bias, the actual values will depend upon their work functions. If the modulator grid is at zero DC bias and it and the cathode have the same work function $\emptyset$, then the most appropriate bias potential for the cathode will be approximately $-\emptyset$, so that emitted electrons will have substantially zero kinetic energy at the modulator grid 16.

As indicated in FIG. 3, the device structure can be considered in terms of three essential parts, namely an electron source 21, a modulator 22 and a collector 23, for each of which a number of different configurations may be provided.

Figure 4:
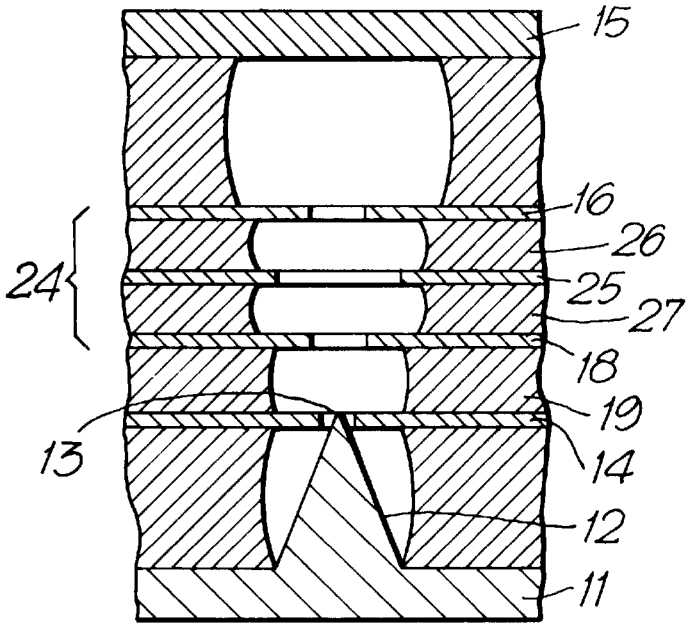
FIG. 4 is a schematic cross-sectional view of a third configuration of vacuum switching device in accordance with the invention.

Electron beam collimation may be advantageous, both for increasing the value of $g_m$ by ensuring that substantially all of the electrons have the same longitudinal momentum, and for ensuring that few of the electrons are collected on the intermediate electrodes between the cathode and the anode or on the supporting dielectric layers. A suitable collimating electrode structure is shown in FIG. 4. In this case, the modulator section 24 comprises an additional focusing electrode or cut-off grid electrode 25 disposed between the grids 16 and 18 and insulated therefrom by dielectric layers 26 and 27.

The performance of the modulator section can be enhanced by setting its bias potential so that it is substantially equal to the anode potential. Suitable bias voltages relative to the cathode are shown in FIG. 4. This would also facilitate cascading of successive devices. The cut-off grid 25 is biased in order to provide a potential minimum of about 0 volts within its aperture. This potential minimum is then modulated by a separate modulator at a higher bias voltage which, for a collimated beam and suitable grid separations in the modulator structure, will intercept little current. Although values of ±30 volts are shown in the figure, the optimum values for these voltages will be determined by the precise device dimensions. Again the cathode should preferably be biased at approximately $-\emptyset$, where $\emptyset$ is its work function, in order that the zero potential point shall correspond to zero electron kinetic energy.

Since the modulator grid 16 and the anode 15 are preferably biased at the same potential, it would be advantageous to provide a suppressor grid between them and biased to a higher positive potential. This would reduce secondary electron coupling between the modulator grid and the anode, and would also decrease the transit time between them.

Figure 5:
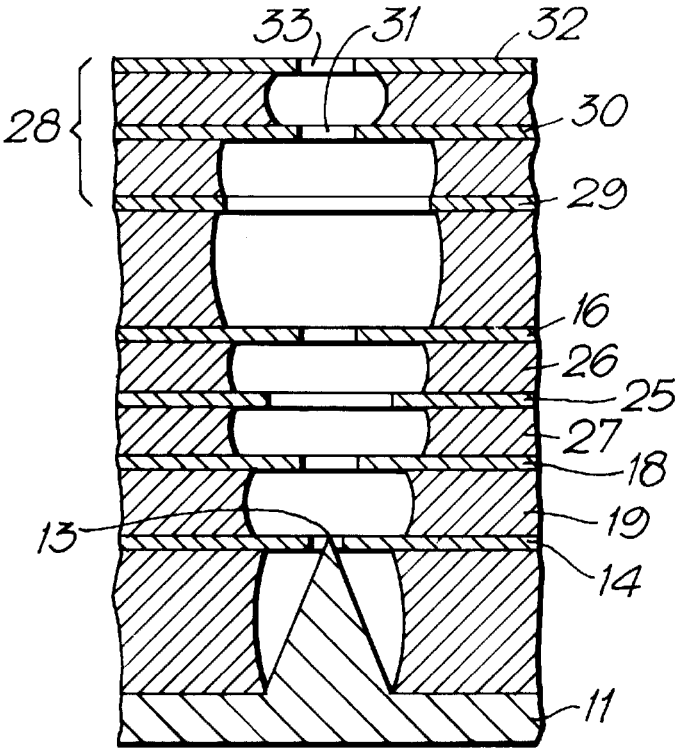
FIG. 5 is a schematic cross-sectional view of a fourth configuration of vacuum switching device in accordance with the invention.

For fabrication purposes it may be advantageous to provide an aperture through the anode layer in line with the cathode tip, in which case a further retarder grid would be required, beyond the anode, to prevent electrons from overshooting the anode by passing through its aperture. Such overshooting would increase the electron transit time and provide parasitic coupling to neighbouring devices. An electrode configuration of this kind is shown in FIG. 5, in which the collector structure 28 comprises the suppressor grid 29, the anode 30 with its aperture 31, and the retarder grid 32 with a corresponding aperture 33. Suitable bias levels are shown in the figure. It should be noted that the modulator grid 16 and the collector grids 18 and 30 have the same DC bias and that the output can be taken from either collector grid. Hence, the device of FIG. 5 operates as a complementary output switch, with useful outputs being obtained in both the "off" and "on" states of the switch.

We claim:

1. A vacuum switching device comprising a cathode; extraction electrode means adjacent the cathode for causing electron flow from the cathode; modulation grid means spaced from the cathode and the extraction electrode means for modulating the electron flow; an anode structure spaced from the modulation grid means for receiving the modulated electron flow in an ON state of the device; and collector electrode means disposed between the extraction electrode means and the modulation grid means for collecting electrons returned towards the cathode by the modulation grid means in an OFF state of the device; the cathode, the extraction electrode means, the collector electrode means, the modulation grid means and the anode structure being all provided in a unitary layer structure.

2. A device as claimed in claim 1, comprising focusing electrode means disposed between the collector electrode means and the modulation grid means for collimating the electron flow.

3. A device as claimed in claim 1, wherein the anode structure comprises a collector grid, together with a suppressor grid disposed between the collector grid and the modulation grid means.

4. A device as claimed in claim 3, wherein the collector grid has an aperture therethrough substantially in alignment with the electron flow path.

5. A device as claimed in claim 4, wherein the anode structure further comprises a retarder grid located at the remote side of the collector grid from the cathode, which retarder grid when biased substantially prevents electron flow through said aperture in the collector grid.

* * * * *